US005467717A

United States Patent [19]

Theurer et al.

[11] Patent Number: 5,467,717

[45] Date of Patent: Nov. 21, 1995

[54] WORK TRAIN FOR EXCHANGING OLD TIES FOR NEW TIES

[75] Inventors: Josef Theurer, Vienna; Herbert Wörgötter, Gallneukirchen, both of Austria

[73] Assignee: Franz Plasser Bahnbaumaschinen-Industriegesellschaft m.b. H., Vienna, Austria

[21] Appl. No.: 359,444

[22] Filed: Dec. 20, 1994

Related U.S. Application Data

[63] Continuation-in-part of Ser. No. 272,133, Jul. 8, 1994, abandoned.

[30] Foreign Application Priority Data

Dec. 7, 1993 [AT] Austria ..... A2478/93

[51] Int. Cl.[6] ..... E01B 29/06

[52] U.S. Cl. ..... 104/6; 104/9

[58] Field of Search ..... 104/2, 5, 6, 9

[56] References Cited

U.S. PATENT DOCUMENTS

| | | | |
|---|---|---|---|
| 4,236,452 | 12/1980 | Theurer et al. | 104/6 X |
| 4,542,697 | 9/1985 | Cicin-Sain | 104/6 X |
| 4,809,614 | 3/1989 | Theurer et al. | 104/9 X |
| 4,878,435 | 11/1989 | Theurer | 104/9 |
| 4,884,509 | 12/1989 | Theurer et al. | 104/9 |
| 4,955,302 | 9/1990 | Theurer et al. | 104/9 |
| 5,125,345 | 6/1992 | Theurer et al. | 104/9 |
| 5,193,461 | 3/1993 | Theurer et al. | 104/9 X |

FOREIGN PATENT DOCUMENTS 389338 11/1989 Austria .

*Primary Examiner*—Robert J. Oberleitner
*Assistant Examiner*—Kevin D. Rutherford
*Attorney, Agent, or Firm*—Collard & Roe

[57] ABSTRACT

A work train for exchanging old ties for new ties and comprising sequentially arranged cars including freight cars for storing old ties and new ties, the train extending in a longitudinal direction and the cars being movable in an operating direction along an existing railroad track comprised of rails fastened to the old ties resting on a ballast bed. The train comprises a tie exchange device for laterally pulling respective ones of the old ties out of the track, a crane for transporting the old ties pulled out of the track and movable in the longitudinal direction, the crane comprising a tie gripping device, and a tie transport device on one of the cars at one end of the train for placing the new ties at the one train end.

11 Claims, 2 Drawing Sheets

WORK TRAIN FOR EXCHANGING OLD TIES FOR NEW TIES

REFERENCE TO RELATED APPLICATION

This is a continuation-in-part of our application Ser. No. 08/272,133, filed Jul. 8, 1994, now abandoned.

BACKGROUND OF THE INVENTION

1. Field of the Invention

The present invention relates to a work train and a method for exchanging old ties for new ties. The train comprises sequentially arranged cars including freight cars for storing old ties and new ties, the train extending in a longitudinal direction and the cars being movable in an operating direction along an existing railroad track comprised of rails fastened to the old ties resting on a ballast bed, the train comprising a tie exchange device for laterally pulling respective ones of the old ties out of the track, and a crane for transporting the old ties pulled out of the track and movable in the longitudinal direction, the crane comprising a tie gripping device.

2. Description of the Prior Art

U.S. Pat. No. 4,809,614 discloses such a work train with a number of work cars and a number of freight cars for storing old and new ties preceding the work cars in the operating direction. The work cars have upwardly recessed machine frames receiving various tie exchange devices which are adjustable with respect to the longitudinal direction on the machine frames so that the ties may be exchanged while the train continuously moves along the track. A guide track atop the freight cars and the work cars extends along the train and supports a gantry crane for transporting old and new ties along the train. With this work train, the entire tie exchange operation, including loosening and removing the old ties, rehabilitating the ballast bed, inserting and fastening the new ties, tamping the ballast, and sweeping the track can be accomplished in a single operation as the work train continuously moves along the track.

The work train disclosed in U.S. Pat. No. 4,878,435 is comprised of two independently moving units, a first one of which carries a tie pulling device for removing the old ties while the second unit carries a similarly structured tie inserting device for the new ties. Each unit is coupled to a freight car for storing the old and new ties, respectively, with a gantry crane for transporting the ties.

U.S. Pat. No. 5,193,461 discloses a tie exchange machine with a tie exchange device which both removes old ties and inserts new ties while the machine stands still. A freight car is coupled to the machine for storing the old and new ties, and a gantry crane for transporting the ties runs between the freight car and a tie storage device arranged on the frame of the machine adjacent the tie exchange device.

Austrian patent No. 389,338 discloses a tie exchange work train with work cars and freight cars for storing ties coupled thereto. Two gantry cranes run on guide tracks extending the length of the train for respectively transporting the removed old ties and the new ties to be inserted. A special motorized crane is provided for unloading the new ties from the deep freight cars.

SUMMARY OF THE INVENTION

It is the primary object of this invention to provide a work train of the first-described type which has a high operating efficiency while being usable under difficult operating conditions with a minimal technical effort.

The above and other objects are accomplished according to one aspect of the invention with a work train for exchanging old ties for new ties and comprising sequentially arranged cars including freight cars for storing old ties and new ties, the train extending in a longitudinal direction and the cars being movable in an operating direction along an existing railroad track comprised of rails fastened to the old ties resting on a ballast bed. The train comprises a tie exchange device for laterally pulling respective ones of the old ties out of the track, a crane for transporting the old ties pulled out of the track and movable in the longitudinal direction, the crane comprising a tie gripping device, and a tie transport device on one of the cars at one end of the train for placing the new ties on the railroad track at the one train end.

According to another aspect, the present invention provides a method of exchanging old ties for new ties with a work train comprising sequentially arranged cars including freight cars for storing old ties and new ties, the train extending in a longitudinal direction. The method comprises the steps of moving the cars being in an operating direction along an existing railroad track comprised of rails fastened to the old ties resting on a ballast bed, laterally pulling respective ones of the old ties out of the track with a tie pulling device on the train, gripping the old ties pulled out of the track and transporting the pulled-out old ties with a crane movable in the longitudinal direction along the train, gripping respective ones of the new ties stored on one of the freight cars and placing the new ties on the railroad track at one train end, moving an independent tie exchange unit behind the work train in the operating direction, and receiving the respective new ties placed on the ballast bed by the independent tie exchange unit and inserting the new ties with the tie exchange unit in the track.

The work train of this invention provides a technically simple apparatus while assuring the advantageous independence from the new tie insertion stage, which can be effectuated independently with a small tie inserter of conventional structure. Since the work progress depends on the prevailing operating conditions, it may be optimized because it need no longer be timed with the tie insertion stage.

The one car may be one of the freight cars and the tie transport device may comprise a vertically adjustable tie gripping device for receiving respective ones of the new ties stored on the one freight car and for placing the new ties on the railroad track, and a drive for vertically adjusting the vertically adjustable tie gripping device.

According to a preferred embodiment, the tie transport device is a crane comprising an outrigger carrying the vertically adjustable tie gripping device, the outrigger being vertically and laterally adjustable, and the one freight car having transversely spaced guide rails supporting the crane for movement therealong. The outrigger preferably is telescopingly extensible, and the one freight car may comprise a conveyor band extending in the longitudinal direction and arranged to receive respective ones of the new ties and convey the new ties to the vertically adjustable tie gripping device. This arrangement makes it possible for the crane to operate somewhat independently in conformity with the required number of new ties, on the one hand, and the stored new ties, on the other hand. For example, when the removal of the old ties causes a temporarily slower work progress, a relatively long outrigger of the crane may be used to pre-position new ties placed along the track shoulder on the ballast bed at the points at which they are to be inserted. This optimally uses the available time for manipulating the ties and thus expedites the tie insertion stage. The conveyor band enables the new ties to be transported independently of the crane and below the crane to the rear end of the train. This then enables the crane outrigger to grip and rapidly place the ties on the track or adjacent thereto.

Optimal conditions for placing the new ties can be obtained if the work train further comprises transversely spaced guide rails extending along the train on the sequentially arranged freight cars, a gantry crane movable along the guide rails for transporting new ties, at least a front section of the conveyor band with respect to the operating direction is arranged between the guide rails on the one freight car, the tie transport device is a crane comprising an outrigger carrying the vertically adjustable tie gripping device, the outrigger being vertically and laterally adjustable, and the one freight car has additional transversely spaced guide rails supporting the crane for movement therealong, the additional transversely spaced guide rails extending along a rear section of the conveyor band with respect to the operating direction. This assures a continuous supply of ties to the crane without requiring the time-consuming movement of the crane back and forth so that the new ties may be placed on the ballast bed directly at the end of the train.

If the one train end is the rear end with respect to the operating direction, the new ties may be placed on the ballast bed in a position extending transversely to the track, which expedites the tie insertion operation.

The method of exchanging old ties for new ties provides an advantageous separation of the tie removal and insertion stages so that one operating stage does not interfere with the other. It has the additional advantage that the work train may be used for transporting the new ties and to place them in position for insertion so that no separate transport unit for the new ties is required.

BRIEF DESCRIPTION OF THE DRAWING

The above and other objects, advantages and features of the invention will become more apparent from the following detailed description of certain now preferred embodiments thereof, taken in conjunction with the somewhat schematic drawing wherein.

DETAILED DESCRIPTION OF THE PREFERRED EMBODIMENTS

Figures 1, 2, 3, 4:
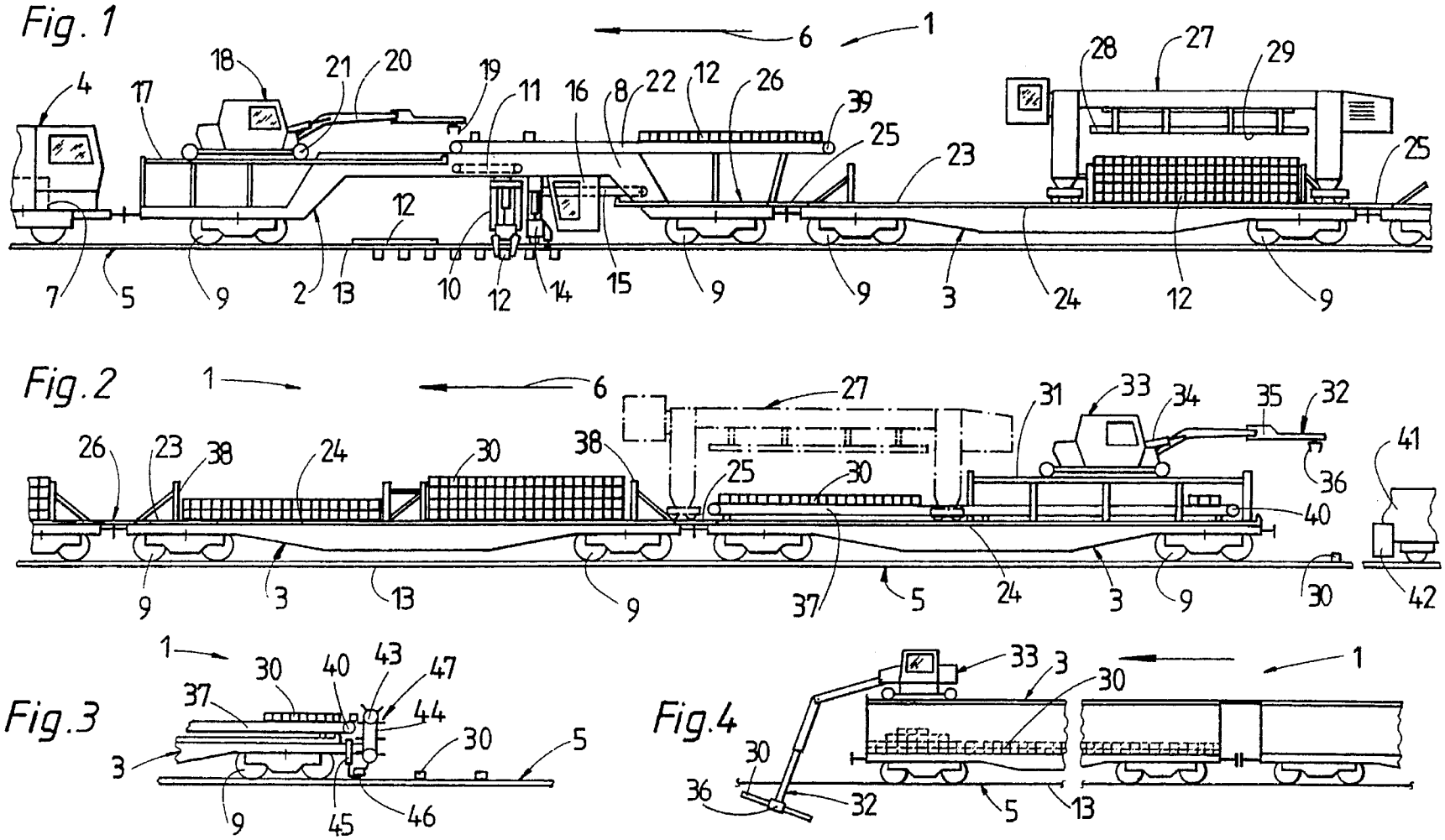
FIGS. 1 and 2 are side elevational views of one embodiment of a work train according to the present invention, FIG. 1 showing, with respect to the operating direction, the front section and FIG. 2 the rear section of the work train for exchanging old ties for new ties.
FIGS. 3 and 4 are fragmentary side views showing two other embodiments of the ends of the work train.

Referring now to the drawing and first to FIGS. 1 and 2, there is shown work train 1 for exchanging old ties 12 for new ties 30. The train comprises track-bound work car 2 and, coupled to the rear end of the work car with respect to the operating direction indicated by arrow 6, sequentially arranged freight cars 3 for storing old ties and new ties. The train extends in a longitudinal direction and cars 2 and 3 are movable in the operating direction along an existing railroad track 5 comprised of rails 13 fastened to the old ties resting on a ballast bed. The front end of work car 2 is coupled to locomotive 4 which carries central power plant 7 enabling the locomotive to propel work train 1 along track 5 in the operating direction.

Work car 2 has upwardly recessed machine frame 8 whose ends are supported on track 5 by undercarriages 9. The upwardly recessed portion of machine frame 8 houses generally conventional, vertically adjustable tie exchange device 10 for pulling old ties 12 out of existing track 5. Tie exchange device 10 is mounted on machine frame 8 and is movable in a guide 11 in the longitudinal direction by means of a drive (not shown). Tie exchange device 10 is capable of laterally pulling old ties 12 out of track 5 and to place the pulled-out ties between rails 13 of track 5. A ballast scarifying or clearing device 14 is arranged on machine frame 8 rearwardly of tie exchange device 10 with respect to the operating direction and is also movable in the longitudinal direction in a guide 15 by means of a drive (not shown). The tie exchange device and the ballast scarifying or clearing device are arranged within sight of operator's cab 16 also mounted on the machine frame in the recessed portion thereof.

The train further comprises crane 18 for transporting the old ties 12 pulled out of track 5 and movable in the longitudinal direction. The crane comprises tie gripping device 19 on outrigger 20. A pair of transversely spaced guide rails 17 is mounted atop machine frame 8 in a front section of the machine frame with respect to the operating direction, and flanged wheels 21 support crane 18 on guide rails 17 for movement in the longitudinal direction. A conveyor band 22 covers a rear section of the machine frame with respect to the operating direction and follows the crane, projecting just beyond a rear end of the work car over a front end of the adjacent freight car 3 with respect to the operating direction. Freight cars 3 are supported on track 5 by undercarriages 9 and, except for the rearmost freight car, are identical. They have loading platforms 23 along whose side edges extend transversely spaced guide rails 24, and intermediate guide rail pieces 25 are linked to the guide rails of adjacent freight cars to form a continuous guide track 26 extending along the entire length of all the freight cars.

According to the invention, tie transport device 32 is mounted on one of the freight cars 3 at one end of train 1, the tie transport device comprising vertically adjustable tie gripping device 36 for receiving respective ones of new ties 30 stored on the one freight car and placing the new ties on the track or the track shoulder. Drive 34 is provided for vertically adjusting vertically adjustable tie gripping device 32. Throughout the specification and claims, placing the ties on the railroad track encompasses placing the ties on the track rails, between the track rails or on a track shoulder laterally adjacent the track rails.

In the embodiment shown in FIG. 2, tie transport device 32 is a crane 33 comprising outrigger 35 carrying vertically adjustable tie gripping device 36, the outrigger being vertically and laterally adjustable by drive 34, and the one freight car having transversely spaced guide rails 31 supporting crane 18 for movement therealong. Outrigger 35 is telescopingly extensible. As shown, the one freight car at the end of train 1 comprises conveyor band 37 extending in the longitudinal direction and arranged to receive respective ones of the new ties 12 and convey the new ties to vertically adjustable tie gripping device 36. Conveyor band 27 may constitute the loading platform of rearmost freight car 3 or may be arranged slightly above its loading platform.

A gantry crane 27 is movable along transversely spaced guide rails 24 extending along the train on the sequentially arranged freight cars 3 for transporting new ties 30. At least a front section of conveyor band 37 with respect to the operating direction is arranged between guide rails 24 on the one freight car, and additional transversely spaced guide rails 31 extend along a rear section of the conveyor band with respect to the operating direction and are elevated from the loading platform or conveyor band 37. The gantry crane has laterally and vertically adjustable tie grippers 29 consisting of L-shaped ledges which can grip a layer of ties and lift them off a stack of ties to transport them along the train to a position indicated in phantom lines in FIG. 2 where the tie grippers 29 are lowered to place the layer of ties on conveyor band 37.

In the illustrated preferred embodiments, the one train end is the rear end with respect to the operating direction.

Before work train 1 is used to exchange old ties 12 for new ties 30, the new ties are stored on loading platforms 23 of freight cars 3, leaving a little room on the loading platforms for the old ties. The ties are stored in stacks of superposed layers, as illustrated, between upright supports 38 and oriented transversely to the track. The upright supports stabilize the stacks of stored ties during the movement of the train in the operating direction along existing railroad track 5. When work train 1 arrives at the operating site, respective ones of old ties 12 are pulled laterally out of track 5 with tie pulling device 10 and deposited between track rails 13. If only a single tie is to be replaced, it can be pulled out and placed between the track rails while the work train advances continuously, simply by synchronizing the movement of tie exchange device 10 along guide 11 with the forward movement of the train. If several sequentially arranged ties are to be pulled out, the tie removal operation is usually effectuated while the train stands still.

Old ties 12 pulled out of track 5 are gripped by tie gripping device 19 and are lifted through a central opening in machine frame 8 and transported with crane 18 to conveyor band 22 which is supported on machine frame 8. Ballast scarifying or clearing device 10 is operated to remove sufficient ballast from the location from which the old tie was removed to enable a new tie 12 to be inserted. During this operation, tie exchange device 10 and ballast scarifying or clearing device 14 are moved along their respective guides 11 and 15 relative to machine frame 8.

Old ties 12 deposited on conveyor band 22 are conveyed to a rear end of work car 2 and are moved together into a compact layer on the conveyor band, which may be accomplished by suitably adjusting the speed of drive 39 of the conveyor band, which is remote-controlled by an operator sitting in the cab of crane 18. This layer of old ties 12 is gripped by tie gripper 29 of gantry crane 27, is moved rearwardly to one of freight cars 3 and is deposited on its loading platform, where the layers of ties are stacked. Periodically, tie gripper 29 of gantry crane is used to grip a respective layer of new ties 30 stored on one of the freight cars, to convey the ties to one end of train 1 (see phantom lines in FIG. 2), where the layer of new ties 30 is deposited on the front section of conveyor band 30 and conveyed forwardly to a position underneath guide rails 31 into reach of tie gripping device 36 by operation of remote-controlled drive 40 of conveyor band 37. The tie gripping device then vertically moves respective new ties 30 stored on the one freight car 3 and places the new ties on the track at the one train end, in a position extending transversely of the track and where the old ties were removed. An independent tie exchange unit 41 is moved behind work train 1 in the operating direction, and a tie inserter 42 receives the new tie placed on the track and inserts the new tie in the track.

The width of tie gripping device 36 is preferably adjustable to enable it to grip, for example, three ties simultaneously if an operator in a cab of crane 33 determines that the scarified location in the ballast bed is wide enough to receive three ties. If there is sufficient time for the operator in crane 33, outrigger 35 and tie gripper 36 may be operated to move a new tie 30 on track 5 to the track shoulder so that it is so pre-positioned for tie inserter 42 to reduce its operation to the tie insertion.

In the embodiment of FIG. 3, tie transport device 47 at the rear end of work train 1 is not a crane but an elevator 44 mounted behind rear undercarriage 9. The elevator is driven by drive 43 and receives new ties 30 from conveyor band 37. It moves the new ties vertically down to a tie laying device 46 driven by drive 45. The operation of conveyor band drive 40, elevator drive 43 and tie laying device drive 45 enables the new ties to be placed on track 5.

The embodiment of FIG. 4 differs from that of FIGS. 1 and 2 essentially only by positioning tie transport device 32 at the front end of work train 1 with respect to the operating direction. New ties 30 stored in freight car 3 are gripped by tie gripping device 36 and are placed on the track shoulder laterally adjacent track 5. As in the embodiment of FIGS. 1 and 2, the old ties are moved at the same time as new ties are placed on the track between track rails 13 and parallel thereto, or on the ballast bed laterally adjacent the track.

Figure 5:
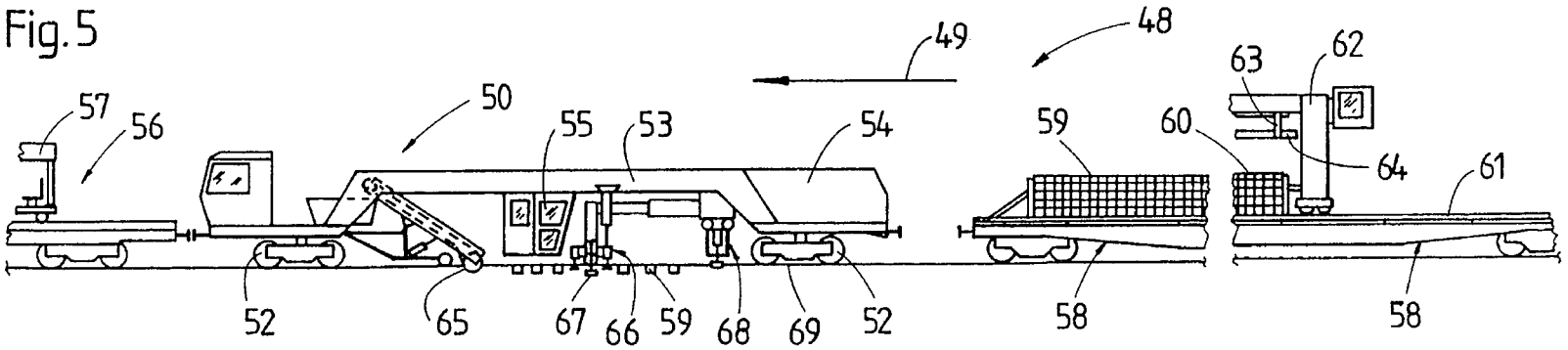
FIGS. 5 and 6 show another embodiment of a work train, in the manner of FIGS. 1 and 2.
Figure 6:
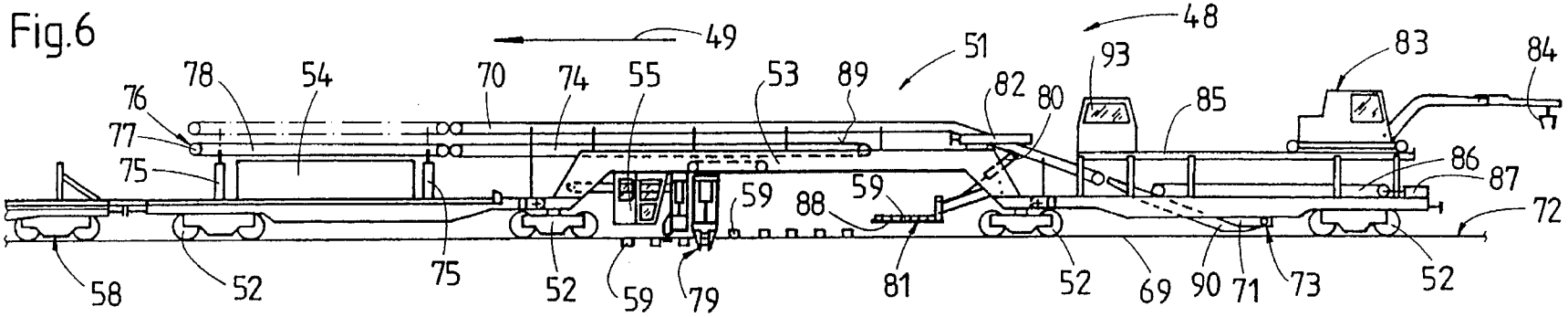

Referring now to FIGS. 5 and 6, there is shown work train 48 for exchanging old ties 59 for new ties 60. The train comprises sequentially, with respect to the operating direction indicated by arrows 49, transport car 56, first work car 50, freight cars 58 for storing old ties 59 and new ties 60, and second work car 51 at the end of the train. Various self-propelled small work cars 57 are loaded on transport car 56 for effectuating prepatory work, such as pulling spikes and the like. The train extends in a longitudinal direction and the work cars are movable in the operating direction along existing railroad track 72 comprised of rails 69 fastened to the old ties resting on a ballast bed.

Each work car 50, 51 has upwardly recessed machine frame 53 supported on the track by undercarriages 52, which carries power plant 54 and operator's cab 55. Gantry crane 62 is movable along guide rails 61 extending in the longitudinal direction on freight cars 58. The gantry crane has tie grippers 63 which may be vertically adjusted by drives 63, as generally described in connection with FIG. 1. The first work group comprised of transport car 56 and first work car 50 is preferably movable independently of the second work group comprised of freight cars 58 and second work car 51. This enables the timing of the various operating tools to be more readily adapted to the prevailing operating conditions.

First work car 50 is equipped with a magnetically operated collecting device 65 for continuously picking up and storing spikes that have previously been pulled to detach the old ties from the rails. Machine frame 53 further carries device 66 for removing the detached old ties by laterally pulling or pushing them out of the track. Tie removing device 66 succeeds operator's cab 55 in the operating direction and is within view thereof, and it is displaceable relative to machine frame 53 in the longitudinal direction. It comprises pressure plate 67 for contacting an end face of the old tie to be removed and is displaceable in a transverse direction for pushing the old tie out. The machine frame further carries a magnetically operating tie plate pick-up device 68 for removing the ties plates located between old ties 59 and track rails 69.

Figure 7:
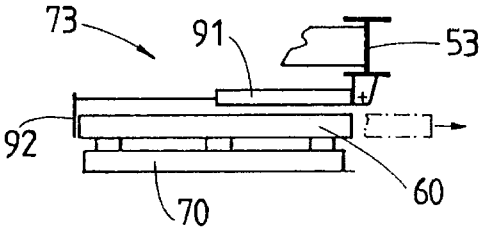
FIG. 7 is a schematic and enlarged illustration of the tie discharge device of FIG. 6.

Second work car 51 carries first tie conveying device 70 for conveying new ties 60. Discharge end 71 of conveying device 70 is located below machine frame 53 immediately above rails 69 of track 72 and immediately ahead of the rearmost undercarriage 52. Tie transport device 90 constituted by tie discharge device 73, which will be described in detail in connection with FIG. 7, is disposed at discharge end 71. Second tie conveying device 74 for conveying old ties 59 is mounted below first tie conveying device. Tie transfer device 76 is mounted on a front end of work car 51 adjacent tie conveying device 70, 74 and is vertically adjustable by drives 75 for alignment with a respective one of the tie conveying devices, as indicated by full and phantom lines in FIG. 2. Tie transfer device 76 is comprised of conveyor belt 78 running in the longitudinal direction and driven by drive 77.

Old tie pulling device 79 is carried by machine frame 53 and is displaceable relative thereto in the longitudinal direction immediately behind operator's cab 55 and within view thereof. In addition, the machine frame carries tie lifting device 81 which is vertically adjustable by drive 80. Jacking device 82 is mounted above lifting device 81 and extends horizontally in the longitudinal direction for moving the old ties on the tie lifting device to second conveying device 74.

Alternatively, the tie transport device for new ties 60 may comprise crane 83 with tie gripping device 84 for placing the new ties on track 72, as described in connection with FIG. 2. The crane runs on rails 85, and conveyor band 86 is arranged below the crane rails for displacement in the longitudinal direction by drive 87.

As shown in FIG. 7, tie transport device 73 comprises jack 91 linked to machine frame 53 of second work car 51 and extending perpendicularly to the longitudinal direction and transversely to track 72. Pressure plate 92 is affixed to the free end of the piston rod of jack 91 for engaging an end face of a new tie 60 to be pushed out from discharge end 71 of conveying device 70. Jack 91 is remotely controlled by an operator in cab 93 mounted in an area of the track from which old ties 59 have been removed.

The work train illustrated in FIGS. 5 and 6 operates in the following manner:

The train is moved continuously in the operating direction indicated by arrows 49. In preparation for the tie exchange, old ties 59 are detached from rails 69 by pulling the spikes by means of one of the small work cars 57 carrying spike-pulling tools. The pulled spikes are picked up and collected by magnetic pick-up device 65. Pressure plate 67 of tie pushing device 66 is engaged with an end face of an old tie to be exchanged, and the tie pushing device is actuated to displace old tie 59 laterally to move it by a distance corresponding to about a third of the length of the tie. At the same time, track rails 69 are slightly raised, and the tie plates exposed by this lateral movement of the tie are subsequently picked up and stored by magnetic pick-up device 68. As the train continues to advance, the displaced old tie is pulled out completely from track 72 by tie pulling device 79 on second work car 51, and is placed on rails 69.

Carrier plate 88 of lowered tie lifting device 81 is positioned below the running surface of rails 69, which causes the carrier plate to receive old tie 59 placed on rails 69 and, as the train advances further, sequentially received old ties are pushed back on the carrier plate until the capacity of the carrier plate has been reached. Drive 80 is then actuated to lift carrier plate 88 until it is horizontally aligned with upper course 89 of conveying device 74. Jacking device 82 is then actuated to push the layer of old ties 59 on the carrier plate onto the conveying device, whereupon lifting device 81 is lowered again into the initial position for receiving another layer of old ties placed on rails 69. As soon as a number of old ties 59 corresponding to the capacity of tie lifting device 64 of gantry crane 62 has been reached, conveying device 74 is driven to convey the old ties to transfer conveyor band 78 whence lifting device 64 of gantry crane 62 lifts the ties so that the gantry crane can deposit them on one of the freight cars 58. The gantry crane then takes up a layer of new ties 60 from a freight car on which they are stored and move them back to transfer device 78 which, meanwhile, has been raised by lifting drives 75 into its upper end position (phantom lines) in alignment with upper conveying device 70. If conveyor band 86 is in a forward end position with respect to the operating direction, conveying device 70 will deliver new ties 60 automatically to conveyor band 86, and gripping device 84 of crane 83 will receive them to enable the crane to deposit the new ties on track 72.

Alternatively, drive 87 may displace conveyor band 86 into its rear end position shown in FIG. 6 so that the other tie transport device 90 may be used. Tie pushing device 73 of tie transport device 90 throws the new ties on the shoulder of track 72. These new ties 60 are then inserted into the track by a succeeding small tie exchange carriage (not shown).

What is claimed is:

1. A work train for exchanging old ties for new ties and comprising sequentially arranged cars including freight cars for storing old ties and new ties, the train extending in a longitudinal direction and the cars being movable in an operating direction along an existing railroad track comprised of rails fastened to the old ties resting on a ballast bed, a rearmost car in the operating direction at a rear end of the train being supported on the track by a rear undercarriage in the operating direction, the train comprising (a) a tie exchange device for laterally pulling respective ones of the old ties out of the track, (b) a crane for transporting the old ties pulled out of the track and movable in the longitudinal direction, the crane comprising (1) a tie gripping device, and (c) a tie transport device on the rearmost car at the rear undercarriage for placing the new ties on the railroad track at the rear train end.

2. The work train of claim 1, wherein the rearmost car is one of the freight cars and the tie transport device comprises a vertically adjustable tie gripping device for receiving respective ones of the new ties stored on the one freight car and for placing the new ties on the railroad track, and a drive for vertically adjusting the vertically adjustable tie gripping device.

3. The work train of claim 2, wherein the tie transport device is a crane comprising an outrigger carrying the vertically adjustable tie gripping device, the outrigger being vertically and laterally adjustable, and the one freight car having transversely spaced guide rails supporting the crane for movement therealong.

4. The work train of claim 3, wherein the outrigger is telescopingly extensible.

5. The work train of claim 2, wherein the rearmost freight car comprises a conveyor band extending in the longitudinal direction and arranged to receive respective ones of the new ties and convey the new ties to the vertically adjustable tie gripping device.

6. The work train of claim 5, further comprising transversely spaced guide rails extending along the train on the sequentially arranged freight cars, a gantry crane movable along the guide rails for transporting new ties, at least a front section of the conveyor band with respect to the operating direction being arranged between the guide rails on the one freight car, the tie transport device being a crane comprising an outrigger carrying the vertically adjustable tie gripping device, the outrigger being vertically and laterally adjustable, and the rearmost freight car having additional transversely spaced guide rails supporting the crane for movement therealong, the additional transversely spaced guide rails extending along a rear section of the conveyor band with respect to the operating direction.

7. The work train of claim 1, wherein the rearmost car at the end of the train is a work car, further comprising a tie removing device mounted on the work car and preceding the tie transport device in the operating direction, and a vertically adjustable tie lifting device mounted on the work car between the tie removing device and the tie transport device, the tie removing device being arranged to place old ties removed from the track on the track rails and the tie lifting device being arranged to raise the old ties placed on the track rails to a desired level.

8. The work train of claim 7, further comprising a first conveying device mounted on the work car above the tie removing and lifting devices, the first conveying device extending in the longitudinal direction for conveying the new ties to the tie transport device, and a second conveying device mounted on the work car below the first conveying device and extending substantially parallel thereto, the second conveying device being arranged to receive the raised old ties from the tie lifting device.

9. The work train of claim 8, wherein the first conveying device has a discharge end immediately above the track, and the tie transport device is arranged at the discharge end of the first conveying device, the tie transport device being a jack extending horizontally and substantially perpendicularly to the longitudinal direction for moving the new tie laterally from the discharge end to a shoulder of the track.

10. The work train of claim 8, further comprising a tie transfer device preceding the conveying devices in the operating direction, the transfer device comprising a vertically adjustable conveyor band extending horizontally in the longitudinal direction for horizontal alignment with a respective one of the conveying devices, and a drive for driving the conveyor band.

11. A method of exchanging old ties for new ties with a work train comprising sequentially arranged cars including freight cars for storing old ties and new ties, the train extending in a longitudinal direction, comprising the steps of (a) moving the cars in an operating direction along an existing railroad track comprised of rails fastened to the old ties resting on a ballast bed, (b) laterally pulling respective ones of the old ties out of the track with a tie pulling device on the train, (c) gripping the old ties pulled out of the track and transporting the pulled-out old ties with a crane movable in the longitudinal direction along the train, (d) gripping respective ones of the new ties stored on a rearmost one of the cars in the operating direction at a rear end of the train and placing the new ties on the railroad track at the rear train end, (e) moving an independent tie exchange unit behind the work train in the operating direction, and (f) inserting respective ones of the new ties placed on the railroad track in the track with the independent tie exchange unit.

* * * * *